US006253509B1

(12) United States Patent
Hellwig et al.

(10) Patent No.: US 6,253,509 B1
(45) Date of Patent: Jul. 3, 2001

(54) WORKSPACE PARTITION SYSTEM

(75) Inventors: John Hellwig, Toronto; Steven Verbeek, Aurora; Mike Walker, Toronto, all of (CA); John Francis Gill, Wyoming, MI (US); Randy Joseph Verhasselt, Holland, MI (US); Errol Stafford Pearsons, Grand Haven, MI (US)

(73) Assignee: Teknion Furniture Systems Limited, Downsview (CA)

( * ) Notice: Subject to any disclaimer, the term of this patent is extended or adjusted under 35 U.S.C. 154(b) by 0 days.

(21) Appl. No.: 09/373,737

(22) Filed: Aug. 13, 1999

(51) Int. Cl.[7] ..... E04H 1/00
(52) U.S. Cl. ..... 52/239; 52/220.7
(58) Field of Search ..... 52/239, 220.7

(56) References Cited

U.S. PATENT DOCUMENTS 5,038,539 * 8/1991 Kelley et al. ..... 52/239
5,065,556 * 11/1991 DeLong et al. ..... 52/239 X
5,069,263 * 12/1991 Edwards ..... 52/239 X
5,487,246 * 1/1996 Hodges et al. ..... 52/239 X
5,806,258 * 9/1998 Miedema et al. ..... 52/220.7
6,098,358 * 8/2000 Waalkes et al. ..... 52/239

* cited by examiner

*Primary Examiner*—Peter M. Cuomo
*Assistant Examiner*—Stephen Vu
(74) *Attorney, Agent, or Firm*—Bereskin & Parr

(57) ABSTRACT

A workspace partition system, for example, for an office building includes a relocatable cable raceway that can be positioned selectively at the belt line or at the baseline of a wall panel of the system depending on where power and data communications are required. Each wall panel of the system includes a structural frame. A raceway element can be selectively coupled to the frame in co-operation with any transverse member of the frame. Front and rear cover plates can be attached to mechanically protect cabling within the raceway. This design allows the panel to be reconfigured on site to change the location of the raceway.

6 Claims, 7 Drawing Sheets

20

28
26
24
54
22
28
22
28
48
26
54
46
48
46
54
86
86
58
26
26
42
56

WORKSPACE PARTITION SYSTEM

FIELD OF THE INVENTION

This invention relates to workspace partition systems such as might be used in an office building to provide individual work stations. In principle, however, the invention could find application in any partition system for space within a building.

BACKGROUND OF THE INVENTION

Partition systems for office buildings typically comprise groupings of inter-connected wall panels arranged to define individual work areas. The wall panels may extend from floor to ceiling, in which case the partition system usually has a fixed overall configuration. Cables for providing power and data communications connections can then be routed through the wall panels themselves to appropriate locations within the workspace. Typically, cabling is run overhead and then brought down through the wall panels to work height. Where the wall panels are less than full height, cabling can be run through a column or pole that extends upwardly from the partition system to the ceiling.

Electrical codes require that certain precautions be taken to protect cables within a partition system. Appropriate protection can be achieved relatively easily where the system is substantially fixed. However, flexibility often is required. For example, in some office environments there may be a need to reconfigure a partition system at relatively frequent intervals and/or to change the locations at which power and communications services can be accessed within the system. Electrical receptacles and data jacks may be required at desk height at some locations within the partition system, and at floor height at other locations within the system, and these requirements may change over time.

An object of the present invention is to provide a workspace partition system and a wall panel for use in such a system, in which power and/or data access points can readily be relocated on site, while at the same time providing appropriate protection for the cabling.

SUMMARY OF THE INVENTION

In accordance with one aspect of the invention there is provided a wall panel for a workspace partition system in which the panel includes a rectangular structural frame and a plurality of cladding elements removably secured to the frame. The frame is made up of a pair of spaced parallel uprights and at least two transverse frame members that extend in spaced parallel positions between the uprights generally at right angles thereto. The panel includes a cable raceway that extends between the uprights of the frame and that is defined at the top or bottom side by one of the transverse frame members and at the other side by a raceway element. The raceway element is made up of a frame member that extends parallel to the structural frame member between the uprights, and spacer means extending from the raceway frame member and co-operating with the structural frame member to position the members in spaced parallel positions. Raceway cover plates are coupled to the frame members to define with those members a substantially closed cable raceway extending transversely through the panel. The raceway element is removably coupled at its ends to the uprights so that the element can be repositioned on site in co-operating relationship with another transverse structural frame member of the panel, for relocating the raceway. At least the uprights of the frame include openings for permitting cables to enter and leave the raceway irrespective of the location of the raceway within the panel.

The raceway is not intended as a structural part of the panel in the sense that the panel has sufficient structural strength to be functional even without the raceway in place, though the raceway may add strength. Once the panel has been installed in a partition system, the location of the raceway can easily be changed by removing the raceway element and simply repositioning it in co-operation with a different transverse member of the structural frame. Different configurations of cladding panels will of course be required. Whatever its location, the raceway comprises a substantially closed conduit for cabling extending transversely through the panel. The cabling is protected top and bottom by the frame members and back and front by the cover plates.

Typically, the structural frame of the panel is a metal fabrication comprising primarily channel-shaped members spot welded or secured together by screws. The raceway element can be a channel-shaped member with two or more short channels projecting outwardly from the base to serve as the spacer means referred to previously. Preferably, the transverse frame member which co-operates with the raceway frame member is also channel-shaped and is positioned so that the bases of the channels of the two members face one another. The sides of the channels can then be used as attachment faces for the cover plates. The short channels defining the spacer means can align with openings in the base of the raceway frame member so that the short channels can serve as "chimneys" through which some of the cables can be routed. For example, data communication cables can be routed through the "chimneys" so that they will be maintained separate from and screened from the power cables.

When the top member of the structural frame is a channel, it preferably is positioned so that the channel is open to the top of the panel. Not only is the base of the channel then positioned appropriately to co-operate with the raceway element if required, but the channel itself can serve as a trough into which some of the cabling can be laid for routing of the cabling through the partition system. For example, in a particular grouping of wall panels, data communications cables may be routed into the trough formed by the frame member at the top of one of the panels at an entry point, laid along the trough of that panel and then into the corresponding troughs of other panels. Where a communications jack is required in a particular panel, one of the cables can be routed downwardly through an opening in the base of the channel of the top frame member, to the raceway. Electrical cabling can then travel separately through the panel and is kept away from the data cables.

In the minimum case, the structural frame of the panel has two transverse frame members, one at the top and one at the bottom. The raceway element can then be used in conjunction with either of those two members. Additional transverse frame members can be provided at one or more intermediate locations depending on the height of the panel and its intended application. For example, power and data connections typically are required at floor height or at desk height. In a relatively tall panel, the raceway element will be used in conjunction with the bottom transverse frame member to provide power and data connections at floor level, or in conjunction with an appropriately positioned intermediate member where connections are required at desk height.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
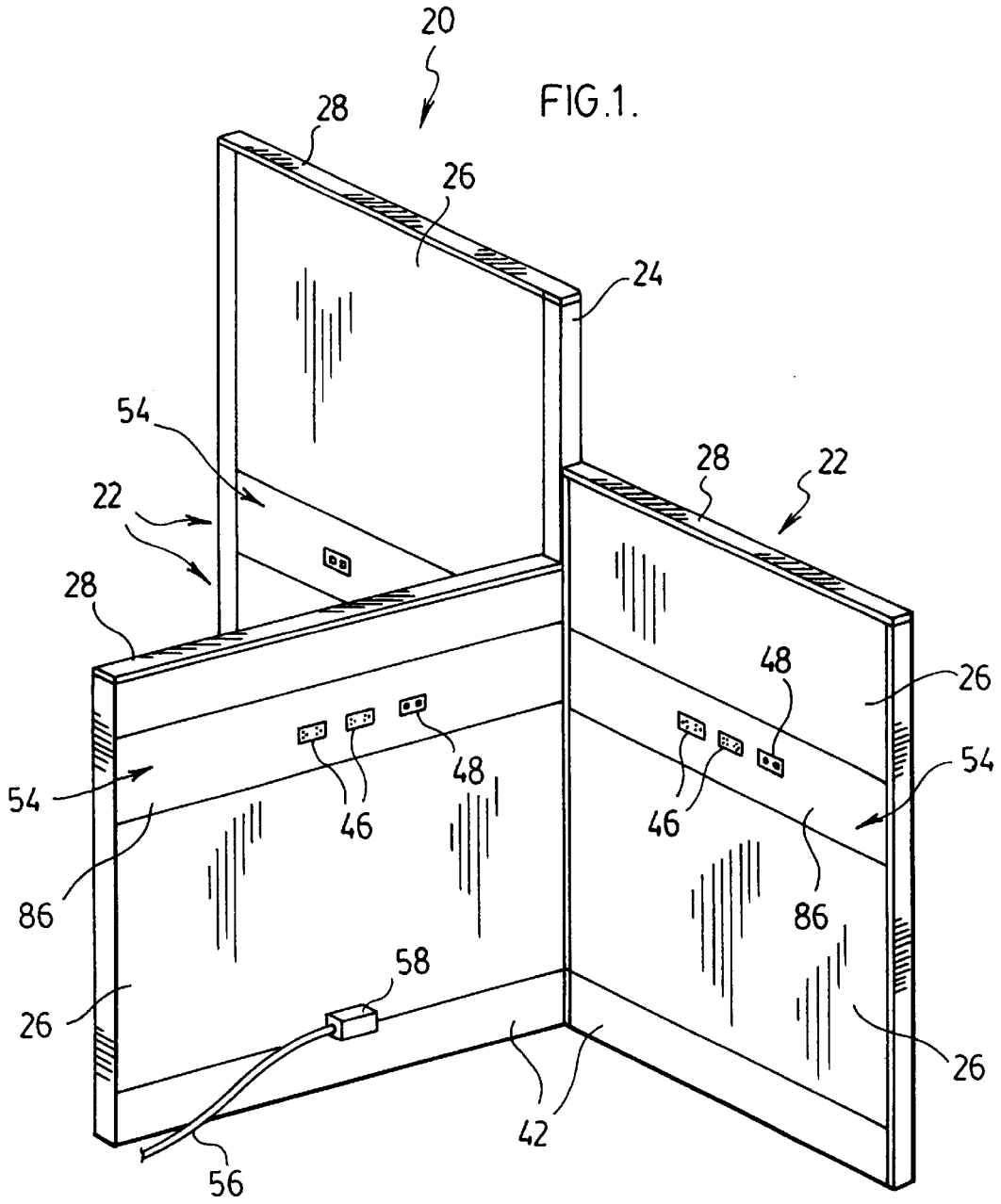
FIG. 1 is a simplified perspective view of a partition system in accordance with the invention.
Figure 2:
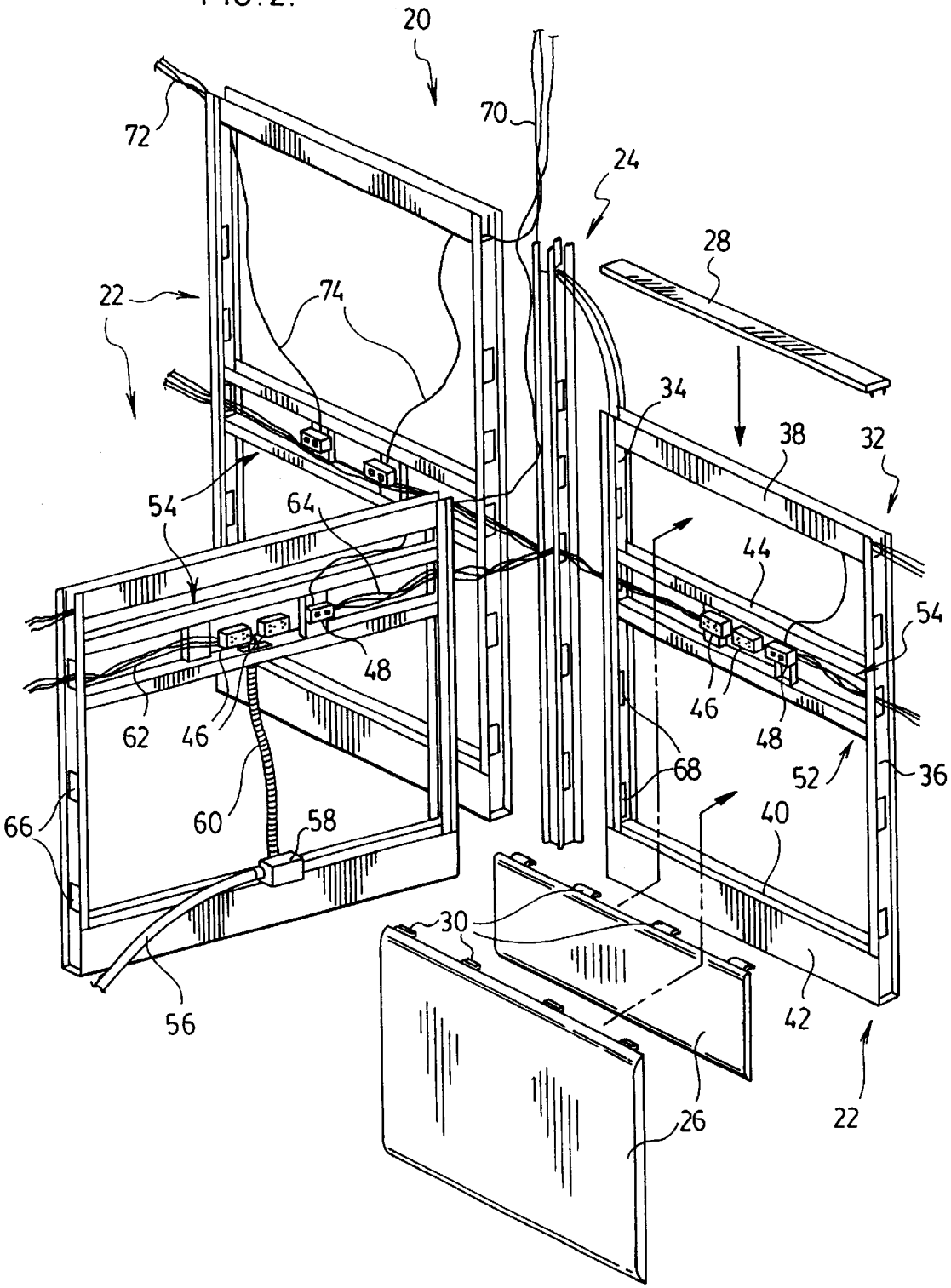
FIG. 2 is a partially exploded perspective view showing the structural frame members and raceway elements of the system of FIG. 1.

Referring first to FIGS. 1 and 2, a workspace partition system in accordance with the invention is generally denoted by reference numeral 20. In this embodiment, the system includes three wall panels 22 that are positioned mutually at right angles and extend outwardly from a column member 24 to which the panels are secured by fasteners (not shown). FIGS. 1 and 2 merely show one very simple configuration of wall panels. Other and more complex configurations are of course possible.

The wall panels 22 are essentially the same but of respectively different heights. Each panel includes a rectangular structural frame and a number of cladding elements that are removably secured to the frame. The frames of the three panels 22 are shown in FIG. 2 and two typical cladding elements for one of the panels are shown in exploded positions at 26. A cap for the top edge of the panel is shown at 28. Elements 26 are provided with clips (some of which are indicated at 30) for engagement in openings in the frame of the panel (e.g. as indicated at 31 in FIG. 3) for removably securing the cladding to the frame. Obviously, a range of elements will be provided in different sizes to suit different panels. The cap 28 snap-fits onto the top edge of the frame; again, similar caps will be provided for each of the panels.

Figure 6:
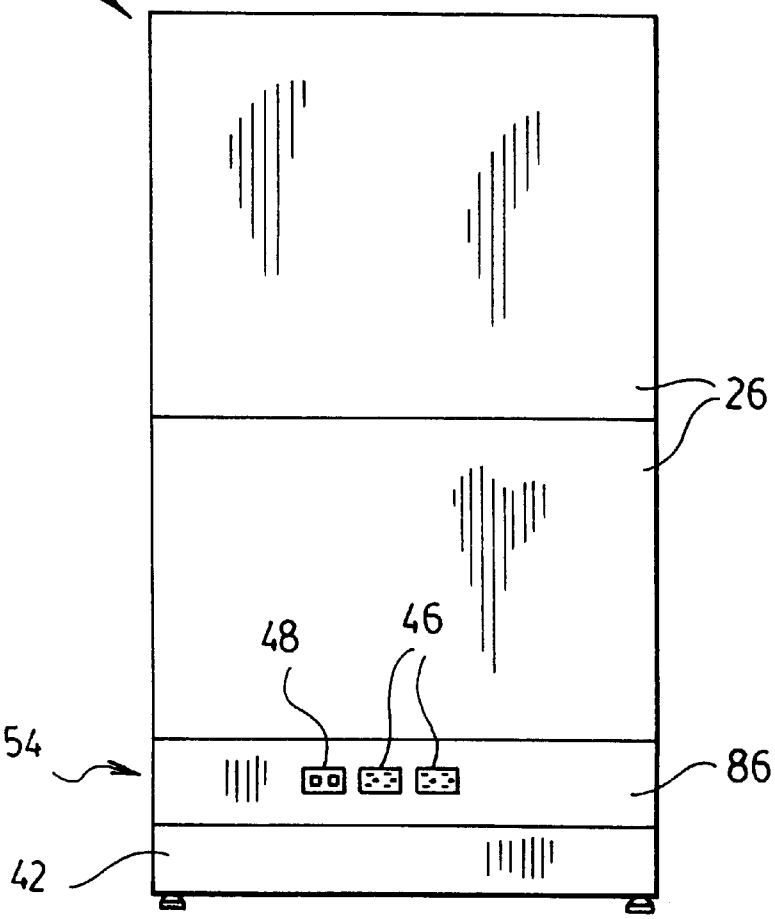
FIGS. 5 and 6 are elevational views of a complete panel showing these two alternative locations for the raceway; Ac FIG. 7 comprises views denoted (a) and (b) showing a raceway element in two alternative orientations.
Figure 5:
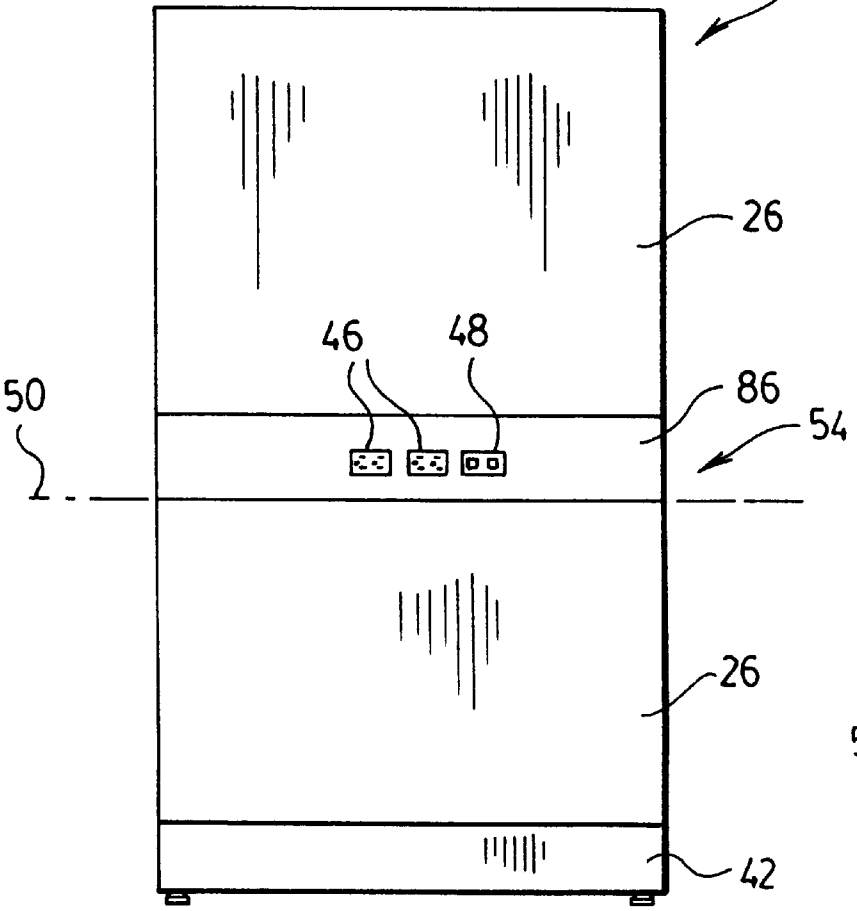

Referring now more particularly to FIG. 2, the frame of the panel 22 that appears on the right is generally denoted 32 and will now be described as a representative example of any of the panels. Frame 32 is made up of a pair of spaced parallel uprights 34, 36 and top and bottom transverse frame members 38 and 40 respectively. Each of the frame members has a generally channel-shaped configuration. It can be seen that the two uprights 34, 36 are oriented with their channels facing inwardly and that the channel members comprising the top and bottom frame members 38, 40 are positioned with their channels facing outwardly and with their end portions received within the channels of the uprights 34, 36. The bottom transverse frame member 40 is positioned at a spacing above the bottom ends of the uprights 34, 36 to accommodate a kick panel 42. In this embodiment, a third transverse frame member extends between the uprights parallel to the top and bottom frame members, and is denoted 44. Shown immediately below member 44 in FIG. 2 are a pair of electrical receptacles 46 and a data jack 48. FIG. 5 shows these components as they would appear in a finished panel and it will be seen that they are positioned generally at the so-called "belt line" of the panel, which would be immediately above a desk surface indicated in ghost outline at 50. FIG. 6 by contrast shows the same components in a "baseline" location immediately above the kick panel 42.

Figures 7A, 7B:
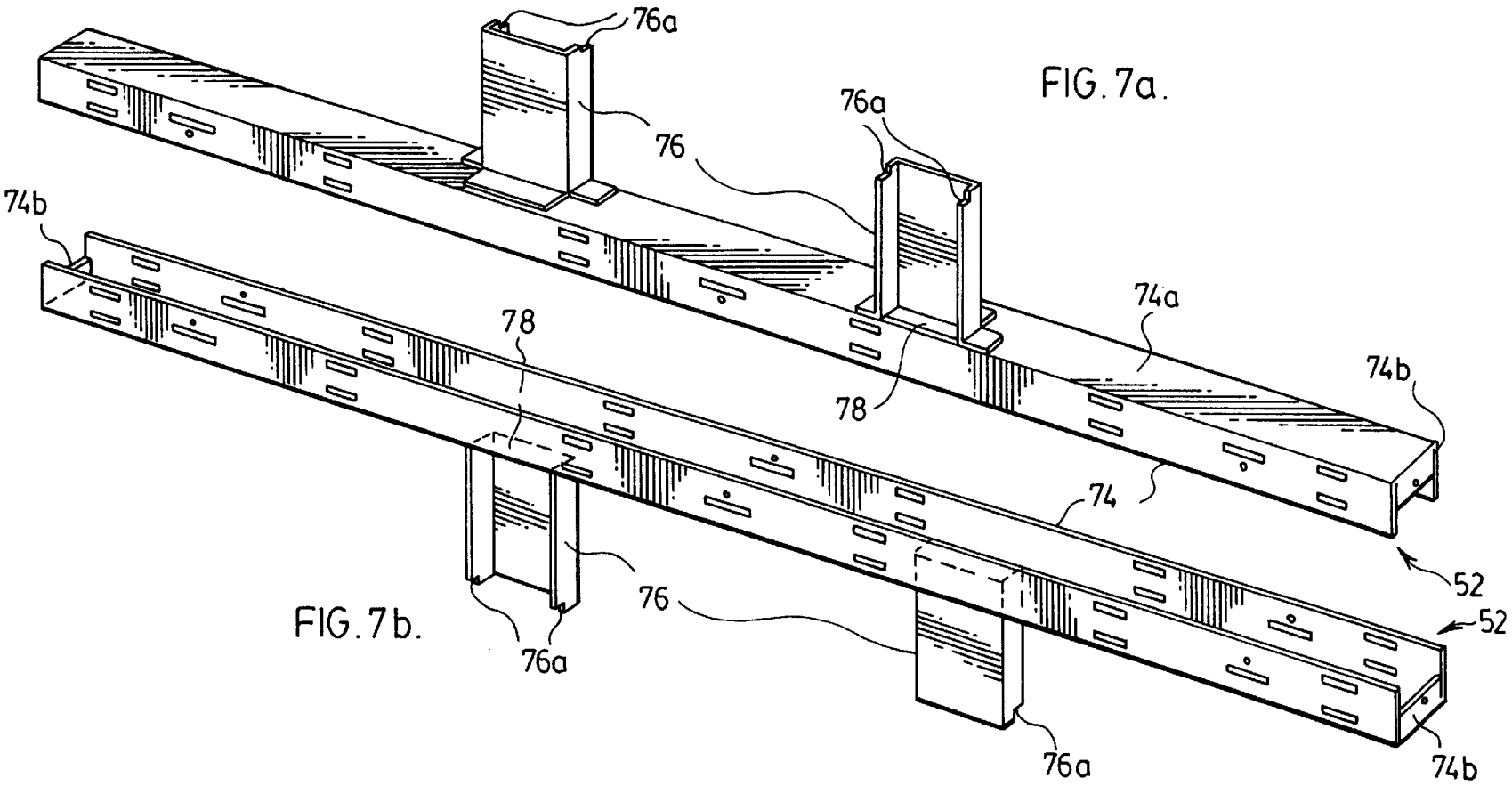

Reverting to FIG. 2, the third frame member 44 co-operates with a raceway element 52 (shown in detail in FIG. 7) to define a raceway 54 that extends transversely of the panel, and in which the receptacles 46 and jack 48 are located. The vertical position of frame member 44 is selected so that, when the raceway is assembled, the receptacles 46 and the jack 48 are in the required belt line location shown in FIG. 5.

The other two panels shown in FIGS. 1 and 2 also have raceways 54 at the belt line. As will be described in more detail below, each of the raceways or any one of the raceways can be moved down to the baseline location illustrated in FIG. 6 by simply repositioning the raceway element 52, or removed altogether.

In the embodiment of FIG. 2, electrical power is supplied to the partition system through a main power supply cable 56 that leads to a junction box 58 carried by the bottom frame member 40 of one of the panels. From the junction box 58, the power cable is led vertically upwardly within the panel, inside an armoured conduit 60 to the receptacles 46. The main power supply cable is connected to a wiring "harness", parts of which are indicated at 62 and 64. The harness includes various snap connectors (see FIGS. 3 and 4) which allow additional wiring to be connected for extending the wiring through the panel system as required. It will be seen that the uprights 34 and 36 of the wall panel frames are provided with relatively large rectangular openings 66 through which the power and data cables are routed. Similar, aligned openings 68 provided in the column 24 at which the panels meet.

Data communication cables preferably are routed through the partition system separately from the power cables. In this embodiment, the data cables are shown extending downwardly from above to the partition system and are indicated at 70. The main power cable 56 could be similarly routed. Whichever cables enter the partition system from above, they will normally extend through a decorative enclosure or column that would in effect be a vertical extension of column 24. From their point of entry at the top of column 24, the data communications cables 70 are laid into troughs that are formed by the top transverse frame members 38 of the panels. The cables can be routed on beyond the panels shown to other adjacent panels, as indicated at 72. At the same time, connections to the jacks 48 within the respective panels can be taken vertically downwardly as indicated at 74 through openings in the bases of the top frame members 38.

Figure 3:
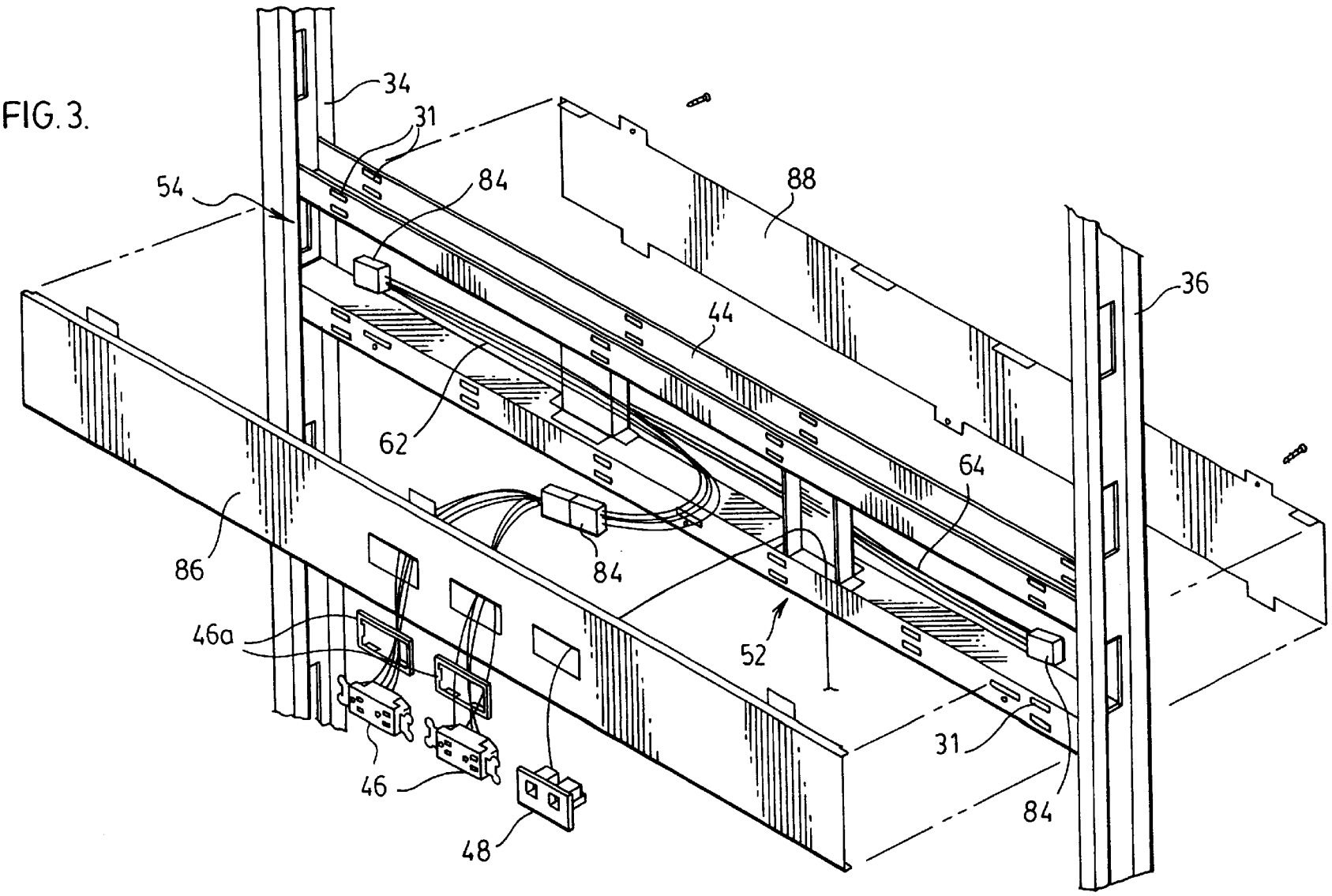
FIG. 3 is an exploded perspective view of part of the wall panel that appears at the right in FIG. 2 showing the raceway at desk ("belt line") height.
Figure 4:
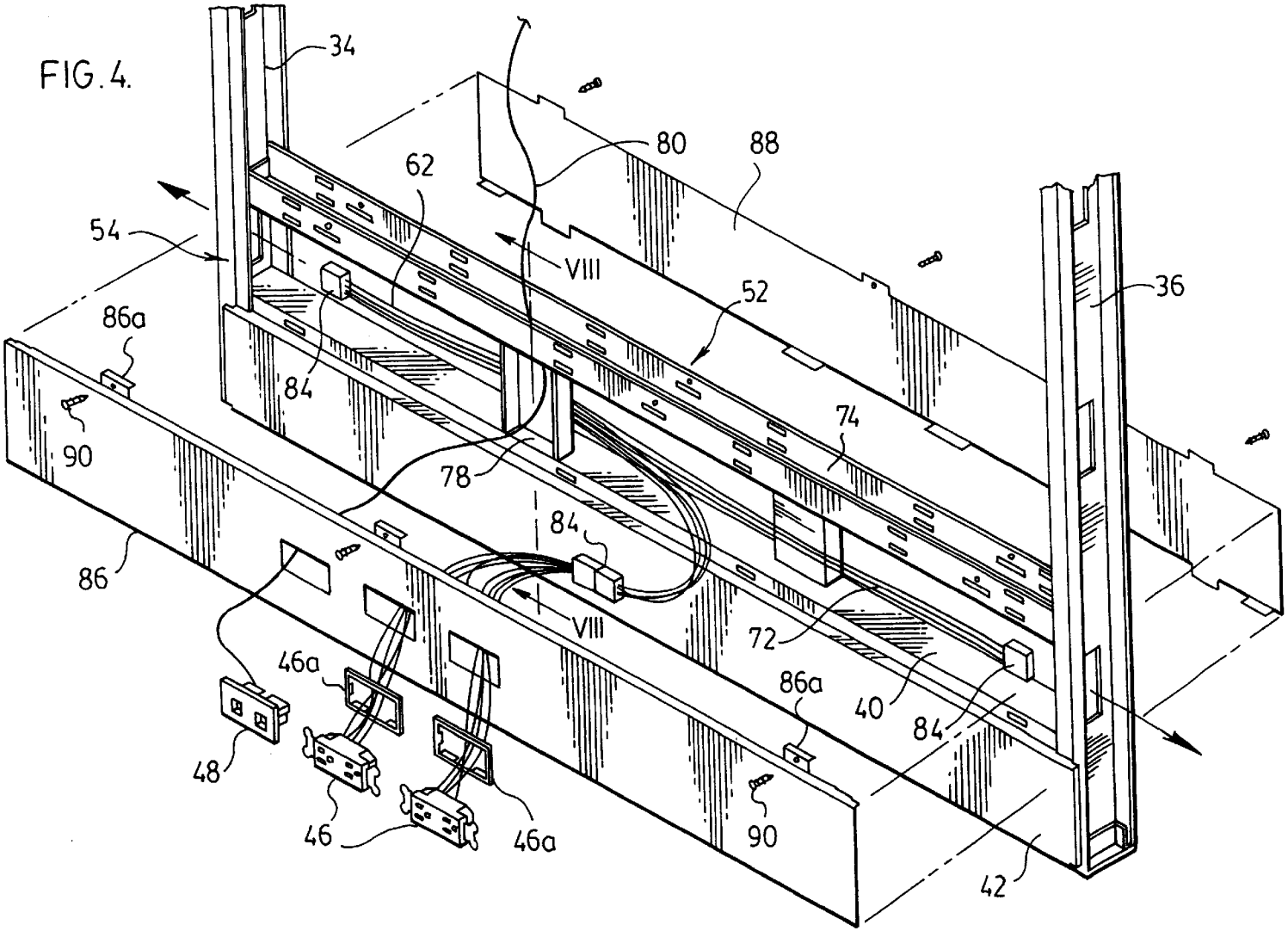
FIG. 4 is a view similar to FIG. 3 showing the raceway positioned at the bottom of the wall panel ("baseline")

FIG. 3 shows in detail the raceway 54 that is formed in part by the intermediate transverse frame member 44 shown in FIG. 2, and by the raceway element 52 shown in FIG. 7. FIG. 4 shows the same raceway element used in conjunction with the bottom frame member 40 to form a raceway at the baseline as shown in FIG. 6. In FIG. 3, the raceway element 52 is below the transverse frame member 44, while in FIG. 4, the raceway element 52 is inverted as compared with FIG. 3 and co-operates with the bottom frame member 40.

FIG. 7(*a*) shows the raceway element 52 in the position it occupies in the belt line position shown in FIG. 3, while FIG. 7(*b*) shows the element in the position of FIG. 4. Raceway element 52 comprises a frame member 74 that is essentially the same as the top and bottom frame members 38 and 40 (i.e. all three members are the same). The member is channel-shaped and is shown in FIG. 7(*b*) with its channel facing upwardly, so that its base 74*a* confronts the corresponding face of the bottom frame member 40 as it appears in FIG. 4. Tabs 74*b* are folded upwardly at the ends of the frame member 74 for receiving sheet metal screws that are driven through those tabs and into the respective uprights 34 and 36 of the frame, for securing the raceway elements within the frame.

The raceway element 52 also includes spacer means in the form of a pair of short channel members 76 that extend outwardly from the base 74*a* of frame member 74. The two channel members 76 are symmetrically offset to respectively opposite sides of the base 74*a* of the frame member and are positioned with their channels facing outwardly in opposite directions, so that the raceway element overall is symmetrical. Openings 78 in the base 74*a* of the frame member align with the respective channel members 76. The channel members 76 are welded in place.

It can be seen that the outer ends of the channel members 76 are notched as indicated at 76*a*. Corresponding openings, one of which is indicated at 78 in FIG. 4, are provided in the transverse frame members 38, 40 and 44 of the panel frame, so that the notches 76*a* in the channel member 76 can fit into the openings in the frame members for locating the channel members with respect to the frame members and providing a conduit or "chimney" through which data cables can be conducted into, out of or through the raceway, for example as indicated by the cable denoted 80 in FIG. 4. In this way, the data cables are mechanically and electrically isolated from the power cables in the raceway.

In FIG. 4, the power cables are indicated at 72. Plug-in connectors incorporated in the power cables are indicated at 84. It will of course be appreciated that there is an opening 78 at the bottom of the "chimney" through which the data cable 80 passes so that the cable could in fact be conducted straight through the raceway if appropriate.

The raceway is always positioned so that the base 74*a* of its frame member 74 confronts a corresponding base surface of the frame member with which the raceway element is to co-operate. Thus, FIG. 7(*a*) shows the raceway element positioned for co-operation with a frame element above, with its base facing down, as in FIG. 3.

In each of FIGS. 3 and 4, the raceway is completed by front and rear raceway cover plates 86 and 88 that are secured to the side flanges of the respective frame members 74 and 40. It is an electrical code requirement that the cover plate should not be removable by hand. Accordingly, tabs 86*a* are provided on the top edge of cover plate 86 for receiving sheet metal screws 90 that are screwed into corresponding holes on the side flanges of the respective frame members 74, 40. Tabs similar to tabs 86*a* are provided at the bottom edge of cover plate 86 but are not visible in FIG. 4. The receptacles 46 are secured to the cover plate in conventional fashion using screws and nuts (not shown) via isolation plates 46*a*. Jack 48 snap-fits into an opening in the cover plate. The cover plate 86 is visible in the assembled panel and therefore has an appropriate decorative appearance to match the cladding panels 26 (e.g. fabric covering). The plate may have the same profile shape (in section) as the cladding panels 26. The cover plate 88 at the opposite side of the panel, however, is not visible in that it is covered by one of the cladding panels (as panel 26—FIG. 2) in the assembled wall panel. Accordingly, plate 88 is simply a flat steel plate having appropriate tabs for receiving screws used to secure the plate to the frame of the wall panel.

Figure 8:
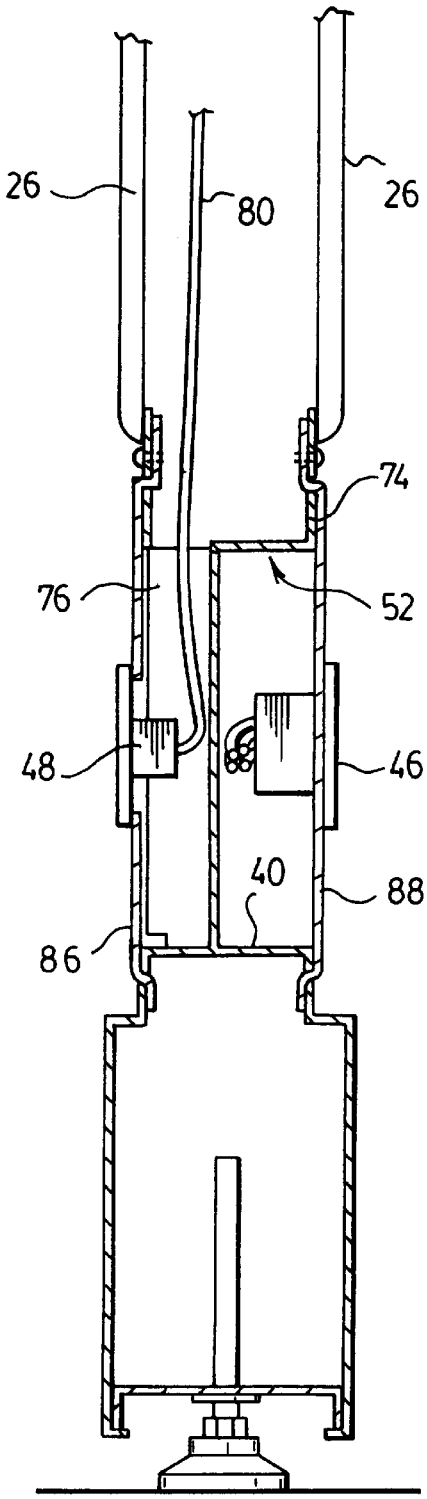
FIG. 8 is a vertical sectional view generally on line VIII—VIII of FIG. 4, with the panel assembled and showing electrical receptacles accessible at both sides of the panel; and, FIG. 9 is a view similar to FIG. 8 showing the raceway at a belt line location and single side receptacle access only.
Figure 9:
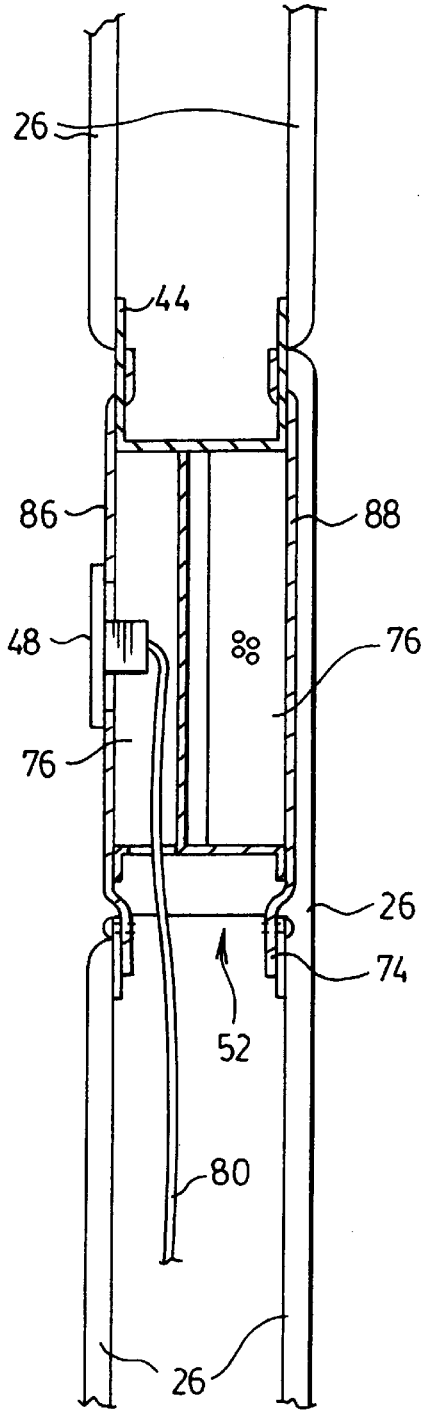

FIG. 8 shows an example of a raceway which is designed to provide double-sided access to electrical receptacles and/or data jacks at a baseline location in a partition system. In this embodiment, both cover plates 86, 88 are visible at the exterior of the panel and can if necessary be removed to provide access to cabling within the raceway. FIG. 9 on the other hand shows an embodiment in which there is only single side receptacle access and plate 88 is covered by one of the cladding panels 26.

It will be appreciated that, in a panel configured for baseline power and data access, it is a relatively simply matter to reconfigure the panel on site for belt line access. Referring to FIG. 4, the cover plates 86 and 88 are first removed and the wiring is removed (after of course removing the cladding panels). Raceway element 52 is then removed by removing the sheet metal screws that extend through the tabs 74*b* at the ends of the frame member of the raceway element (see FIG. 7*a*). The raceway element is then lifted out, inverted and reinstalled in the reverse fashion as shown in FIG. 3. In both locations, the wiring that extends through the raceway is mechanically protected within the raceway. Access to cabling within the raceway is relatively straightforward. It is simply necessary to remove the cladding panels and then one or both of the cover plates 86, 88. The raceway itself can easily be relocated as described previously.

In concluding, it should of course be borne in mind that the preceding description relates to a particular preferred embodiment of the invention only and that many modifications are possible within the broad scope of the invention. Some of those modifications have been indicated previously and others will be apparent to a person skilled in the art.

We claim:

1. A wall panel for a workspace partition system, the panel including a rectangular structural frame and a plurality of cladding elements removably secured to the frame, wherein the frame comprises a pair of spaced parallel uprights and at least two transverse frame members that extend in spaced parallel positions between the uprights generally at right angles thereto, and wherein the panel is provided with a cable raceway that extends between the uprights of the frame;

said cable raceway being defined by:

one of said transverse frame members;

a raceway element comprising a frame member that extends parallel to said one traverse frame member between the uprights and spacer means extending outwardly from the raceway frame member and co-operating with said one traverse frame member to locate the frame member of the raceway element in spaced parallel relationship with respect to said one transverse frame member; and, respective front and rear raceway cover plates that are coupled to the frame members to define with said members a substantially closed conduit extending transversely through the panel;

said raceway element being removably coupled at its ends to said uprights so that the element can be repositioned on site in co-operating relationship with a different transverse frame member of the panel, for repositioning the raceway, at least said uprights including openings for permitting cables to enter and leave the raceway irrespective of its location within the panel.

2. A wall panel as claimed in claim 1, wherein said spacer means comprise at least two channels that project outwardly from said raceway frame member generally at right angles thereto for engagement with said one transverse frame member of the structural frame, each of said frame members being provided with openings that correspond with said channels, to provide passageways through the raceway via said channels and openings.

3. A wall panel as claimed in claim 2, wherein said raceway element includes two said channels, and wherein said channels are oriented oppositely to one another so that the respective channels open to opposite sides of the raceway.

4. A wall panel as claimed in claim 3, wherein each of said channels has a width less than said frame member of the raceway element, and the channels are symmetrically offset from one another to opposite sides of the raceway frame member, so that the raceway element is symmetrical overall.

5. A wall panel as claimed in claim 1, wherein said uprights of the structural frame comprise a pair of channel-shaped members that are oriented with their channels facing inwardly, and wherein each of said transverse members of the structural frame and said frame member of the raceway element extends between the uprights with end portions of each frame member received within the channels of the respective uprights.

6. A wall panel for a workspace partition system, the panel including a rectangular structural frame and a plurality of cladding elements removably secured to the frame, wherein the frame comprises a pair of spaced parallel uprights and at least two transverse frame members that extend in spaced parallel positions between the uprights generally at right angles thereto, and wherein the panel is provided with a cable raceway that extends between the uprights of the frame;

said cable raceway being defined by:

one of said transverse frame members;

a raceway element comprising a frame member that extends parallel to said one traverse frame member between the uprights and spacer means extending outwardly from the raceway frame member and co-operating with said one traverse frame member to locate the frame member of the raceway element in spaced parallel relationship with respect to said one transverse frame member; and, respective front and rear raceway cover plates that are coupled to the frame members to define with said members a substantially closed conduit extending transversely through the panel;

said raceway element being removably coupled at its ends to said uprights so that the element can be repositioned on site in co-operating relationship with a different transverse frame member of the panel, for repositioning the raceway, at least said uprights including openings for permitting cables to enter and leave the raceway irrespective of its location within the panel;

wherein said two transverse frame members of the structural frame are substantially identical channel-shaped members, and are oriented in the frame with their respective channels facing outwardly in opposite directions and the base of each channel facing inwardly of the frame, and wherein the frame member of the raceway element comprises a channel-shaped member that is substantially identical with said transverse frame members and that has a base, from which said spacer means extend, whereby the raceway element can be coupled to the frame in co-operating relationship with either of said transverse frame members, with the base of the raceway element frame member confronting the base of the structural frame member, said cover plates of the raceway being coupled to side faces of the respective channels.

* * * * *